United States Patent [19]

Samuels

[11] 4,342,948

[45] Aug. 3, 1982

[54] ELECTRIC DISCHARGE LAMP CONTROL CONVERTER CIRCUITS

[75] Inventor: Philip R. Samuels, St. Albans, England

[73] Assignee: David Engineering Limited, Haverhill, England

[21] Appl. No.: 188,253

[22] Filed: Sep. 17, 1980

[30] Foreign Application Priority Data

Sep. 20, 1979 [GB] United Kingdom ..... 7932691

[51] Int. Cl.[3] ..... H05B 41/23

[52] U.S. Cl. ..... 315/290; 307/157; 315/283; 315/289; 315/DIG. 2

[58] Field of Search ..... 315/208, 240, 276, 283, 315/289, 290, DIG. 2; 307/157; 361/35, 91, 111

[56] References Cited

U.S. PATENT DOCUMENTS 4,005,336 1/1977 Casella ..... 315/240 X
4,210,850 7/1980 Britton ..... 315/290

FOREIGN PATENT DOCUMENTS 2138589 3/1973 Fed. Rep. of Germany .
52-19481 2/1977 Japan ..... 315/290
54-98067 8/1979 Japan ..... 315/289
1398383 6/1975 United Kingdom .
1461055 1/1977 United Kingdom .
2035725 6/1980 United Kingdom .

*Primary Examiner*—Eugene R. LaRoche
*Attorney, Agent, or Firm*—Robert F. O'Connell

[57] ABSTRACT

A converter circuit for addition to the existing lamp operating circuitry of a high pressure mercury lamp consisting of an existing series ballast inductor and a power factor connecting capacitor connected across the input terminals of the existing lamp operating circuit includes inductance arranged to be connected to the ballast inductor so as to adjust the resultant series inductance to a value suitable for a sodium lamp, and an igniter portion coupled to the converter inductance. The igniter portion operates to apply ignition voltage to the sodium lamp during at least part of the time that the converter circuit is supplied with power. Protective circuitry is coupled to the converter inductance to block or limit high frequency voltage pulses which could otherwise reach the ballast inductor.

11 Claims, 17 Drawing Figures

FIG. 15
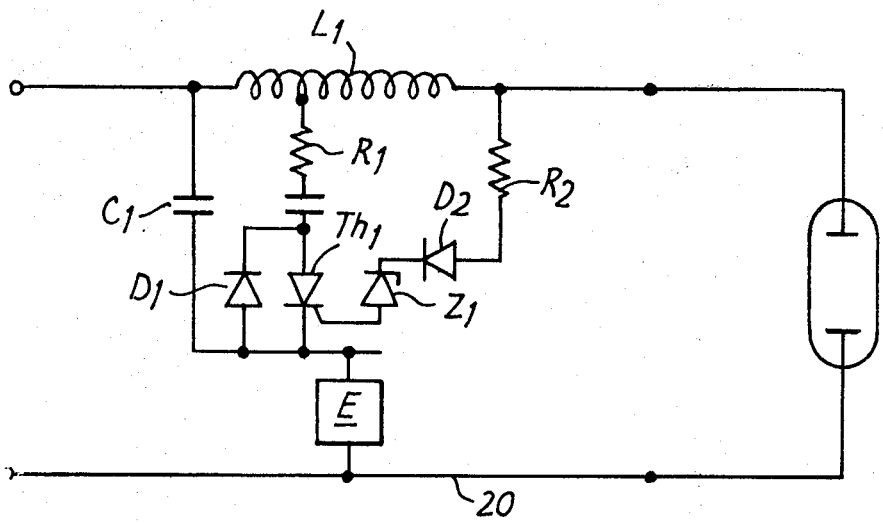
FIG. 16
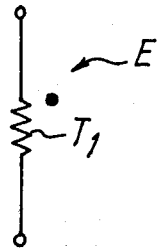
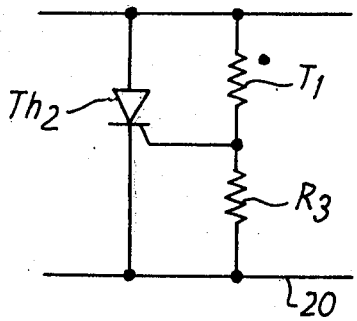
FIG. 17

ELECTRIC DISCHARGE LAMP CONTROL CONVERTER CIRCUITS

BACKGROUND OF THE INVENTION

This invention relates to circuits for electric discharge lamps and especially to circuits to be added as converter circuits to existing discharge lamp circuits to enable a different type of discharge lamp to be operated.

To conserve energy and/or to improve light output it may be desirable to replace an existing discharge lamp of a luminaire with a discharge lamp of another type. For example, in many circumstances it is desirable to replace a high pressure mercury lamp with a high pressure sodium lamp or with a low pressure sodium lamp.

It is known that such different types of discharge lamp have different electrical operating characteristics and accordingly it has hitherto been the practice when replacing a discharge lamp of one type with a discharge lamp of another type to replace the whole of the existing control gear as well as the lamp. For example, the MBF choke for an MBF lamp is, in the prior art, replaced with a leakage reactance transformer where the replacement lamp is a low pressure sodium lamp, and replaced with a combination of a suitable choke and igniter circuit for a high pressure sodium lamp. The power factor capacitor is also replaced for a high pressure sodium lamp.

It is therefore an object of the present invention to provide a means of converting an existing discharge lamp operating circuit for one type of discharge lamp to allow operation of another type of discharge lamp without replacing the existing discharge lamp operating circuit.

It is more particularly an object of the present invention to provide a converter circuit which, when added to an existing operating circuit for a mercury lamp, enables the resultant circuit to operate a sodium lamp.

It is a further object of the present invention to provide a converter circuit comprising circuit components which allow operation of a different type of discharge lamp from the type intended to be operated by an existing lamp operating circuit to which the converter circuit is added, the converter circuit also protecting the components of the existing lamp operating circuit from electrical conditions arising from operation of the discharge lamp of different type or from operation of the converter circuit.

SUMMARY OF THE INVENTION

In accordance with the present invention, a converter circuit is provided for use with an electric discharge lamp operating circuit and having a pair of input terminals for connection respectively to a pair of terminals of the lamp operating circuit, a pair of output terminals for connection to a pair of lamp operating terminals of a replacement electric discharge lamp of a type different from the type which the said lamp operating circuit is intended to operate, an inductor connected in series between one of the input terminals and one of the output terminals, and igniter circuit means so coupled to said inductor as to produce lamp igniting voltage between said output terminals at least during initial operation of the converter circuit. The said inductor combines with inductance in the existing lamp operating circuit to provide a suitable value of series inductance for operation of the replacement lamp. The converter circuit also includes voltage limiting means such as at least to limit the level of the voltage at high frequency applied by the converter circuit to the existing lamp operating circuit. For example, the voltage limiting means may comprise a snubber circuit.

In a preferred embodiment, the said inductor comprises a tapped inductor, and the igniter circuit means includes a semiconductor switching device coupled to a tap connection of the said inductor through a series combination of a capacitor and a resistor, whereby at least one resonant circuit is established by closure of the semiconductor switching device. Trigger means are provided for controlling closure of the semiconductor switching device, the trigger means being preferably coupled across the said output terminals to be controlled by the lamp voltage in operation.

The said inductor may be connected in series or in parallel with a ballast inductor of the existing lamp circuit, and the value of inductance of the said inductor of the converter circuit is determined accordingly so that the effective inductance of the combination of the converter inductor and the existing ballast inductor is a suitable value for running the replacement lamp.

The invention will now be described in more detail, solely by way of example, with reference to the accompanying drawings.

BRIEF DESCRIPTION OF THE DRAWINGS

FIG. 15 is a circuit diagram of a ninth converter circuit according to the invention.

FIG. 16 is a detail diagram of a unit of the converter circuit of FIG. 15.

FIG. 17 is a circuit diagram of an alternative arrangement constituting a unit of the converter circuit of FIG. 15.

DETAILED DESCRIPTION OF THE PREFERRED EMBODIMENTS

Figure 1:
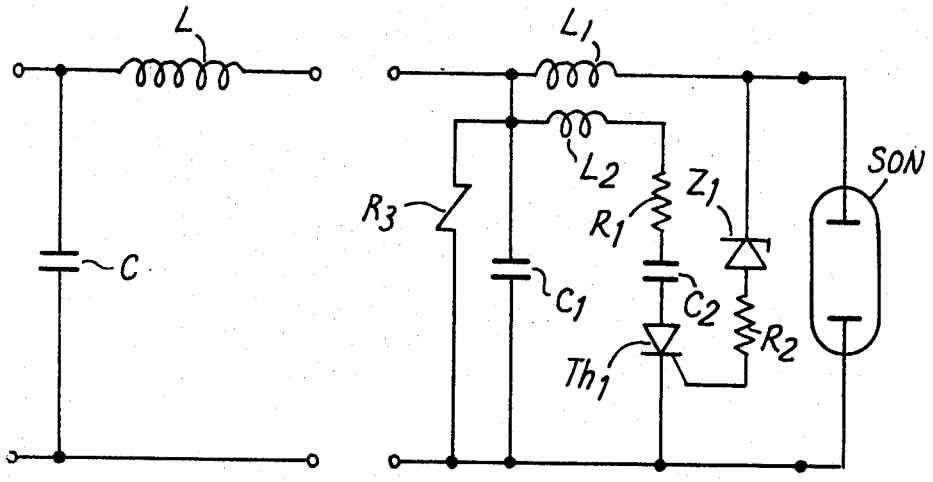
FIG. 1 is a circuit diagram of an existing lamp operating circuit and a first converter circuit according to the invention.

FIG. 1 shows an existing lamp operating circuit consisting of a series ballast inductor L and a power factor correcting capacitor C connected across the circuit input terminals, and a converter circuit to be added to the existing lamp circuit, which is intended to operate a high pressure mercury lamp (an MBF lamp), to produce a combined circuit capable of operating a high pressure sodium lamp (an SON lamp). The converter circuit includes a small inductor $L_1$, which in use is connected in series with the existing ballast inductor L and corrects for the difference between the control current requirements of the MBF lamp and its replacement, the SON lamp. Most frequently, an existing MBF lamp should be replaced by a smaller SON lamp and therefore an increase in the series inductance in the circuit is usually required. If, on the contrary, the replacement lamp draws more current, a converter circuit which reduces the effective series inductance is provided, as will be described hereinafter.

In addition to the inductor $L_1$, the converter circuit includes a small winding $L_2$ consisting of a few turns wound over the inductor $L_1$ so that the two inductors $L_1$ and $L_2$ can act respectively as the secondary and primary windings of a step up transformer. An igniter circuit includes the winding $L_2$, a resistor $R_1$, a capacitor $C_2$ and a thyristor $Th_1$ connected in series between the input terminals of the converter circuit. The trigger of the thyristor $Th_1$ is coupled by a triggering branch to an output terminal of the converter circuit at the output end of the inductor $L_1$. The triggering branch consists of a zener diode $Z_1$ and a resistor $R_2$ in series, the zener diode $Z_1$ being arranged to break down in response to positive voltage at the output end of the inductor $L_1$.

When a a.c. mains power supply is initially connected to the input terminals of the existing lamp circuit with the converter circuit coupling it to the SON lamp, the SON lamp is open circuit. Current flows down the triggering branch formed by the Zener diode $Z_1$ and the resistor $R_2$ to the trigger of the thyristor $Th_1$ which fires shortly after the peak in each positive half cycle of a mains frequency voltage. When the thyristor $Th_1$ fires, the capacitor $C_2$ charges resonantly and the resultant current pulse in the winding $L_2$ induces a pulse in the winding $L_1$ which results in a voltage pulse with a peak value of between 2 kilovolts and 5 kilovolts and a duration of between about 1 and 5 microseconds being applied to the lamp. Such a voltage pulse ignites the SON lamp. After ignition the voltage across the SON lamp settles at a steady value lower than the ignition voltage, and too low for the thyristor $Th_1$ to be fired. The values of the resistors $R_1$ and $R_2$ are chosen to ensure that substantially only the single high voltage ignition pulse is generated in each positive half-cycle of mains frequency.

The ballast inductor L is protected from the high voltage ignition pulses, and any other transient voltage pulses which the SON may generate in operation, by a buffer capacitor $C_1$, which has a simple non-linear resistor $R_3$ connected in parallel therewith, across the input terminals of the converter circuit.

Figure 2:
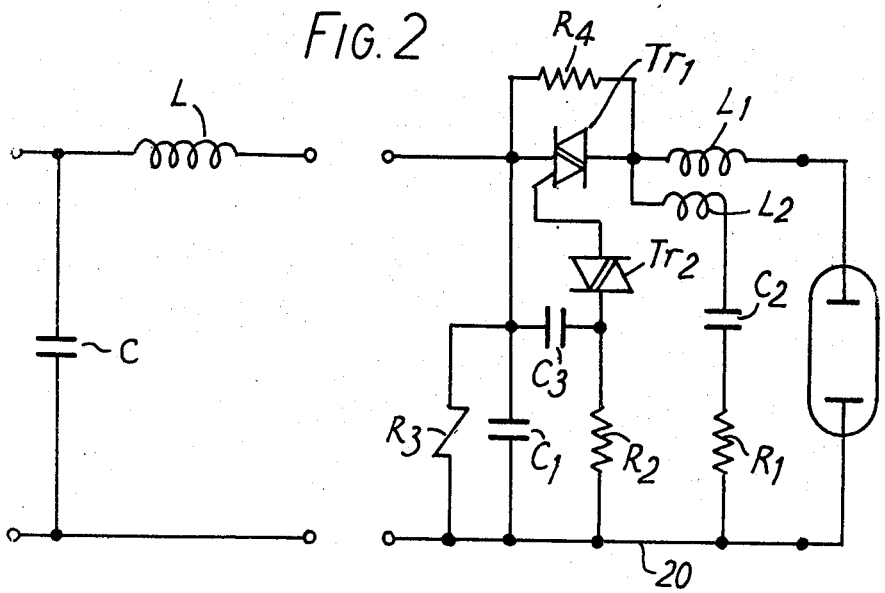
FIG. 2 is a circuit diagram of the existing lamp operating circuit of FIG. 1 and a second converter circuit according to the invention.

FIG. 2 shows the existing lamp operating circuit as in FIG. 1, and an alternative converter circuit which can be miniaturised. In this converter circuit, a semiconductor switching device in the form of a triac $Tr_1$ is connected in series with an inductor $L_1$ between one input terminal and one output terminal of the converter circuit. The inductor $L_1$ is again chosen to adjust the value of the effective series inductance from that of the ballast inductor L alone, which was suitable for an MBF lamp to a series inductance for an SON lamp. When the existing lamp operating circuit is coupled by the converter circuit to the SON lamp and the SON lamp is operating steadily, the triac $Tr_1$ operates at a fixed phase angle in each half cycle of mains frequency, and the generation of back e.m.f. in the inductors L and $L_1$ is limited by a resistor $R_4$ of the order of 100Ω in parallel with the triac $Tr_1$. The inductor $L_1$ has a ferrite core and, in addition to limiting the current to the lamp, acts as the secondary of a step-up transformer whose primary is a very small winding $L_2$ on the inductor $L_1$.

The triac $Tr_1$ is triggered by breakdown of a diac $Tr_2$ in a triggering circuit consisting of the diac $Tr_2$ connected in series with a resistor $R_2$ to a common rail 20, of the converter circuit and a capacitor $C_3$ connected in series with the resistor $R_2$ across the input terminals of the converter circuit. Breakdown of the diac $Tr_2$ occurs whenever the voltage across the capacitor $C_3$ reaches a predetermined magnitude, and occurs once in each half-cycle of mains frequency voltage. The ballast inductor L is protected as in FIG. 1 by a capacitor $C_1$ and a resistor $R_3$ across the input terminals of the converter circuit.

Whenever the diac $Tr_2$ breaks down the capacitor $C_3$ discharges through the diac $Tr_2$ into the triac $Tr_1$. Thus the triac $Tr_1$ is triggered on in each half cycle of mains frequency, and automatically turns off at the end of each half cycle. This switching on and off of the triac $Tr_1$ causes resonant oscillations to be established in the resonant circuits formed by the protective capacitor $C_1$ and the inductor $L_1$, and a capacitor $C_2$, the winding $L_2$ and a resistor $R_1$ which are in series between the triac or input end of the inductor $L_1$ and the common rail 20. The transformer effect of the inductive coupling of the winding $L_2$ to the inductor $L_1$ produces voltage pulses at ignition level for the SON lamp.

When the SON lamp has struck, however, the lamp current flowing in the inductor $L_1$ substantially suppresses the ignition voltage.

Typical practical values for the components of the converter circuit of FIG. 1 when used to convert an existing lamp operating circuit for a 400 watt high pressure mercury lamp to form a circuit for operating a 250 watt high pressure sodium lamp are as follows:

Existing choke: 400 watt Parmar choke.

$L_1$: 160 turns of 1.0 mm diameter wire with 10 turns for $L_2$ wound on a one inch stack of 35A pattern lamination supplied by L & H Limited of England.

$Th_1$: Thyristor type C106

$C_1$: 0.10 μfd $C_2$: 0.33 μfd

Measured total watts on a 240 volt 50 Hz supply with (a) a 400 watt MBF/U lamp: 435 watts (b) a 250 watt SON lamp and converter circuit: 284 watts.

Figure 3:
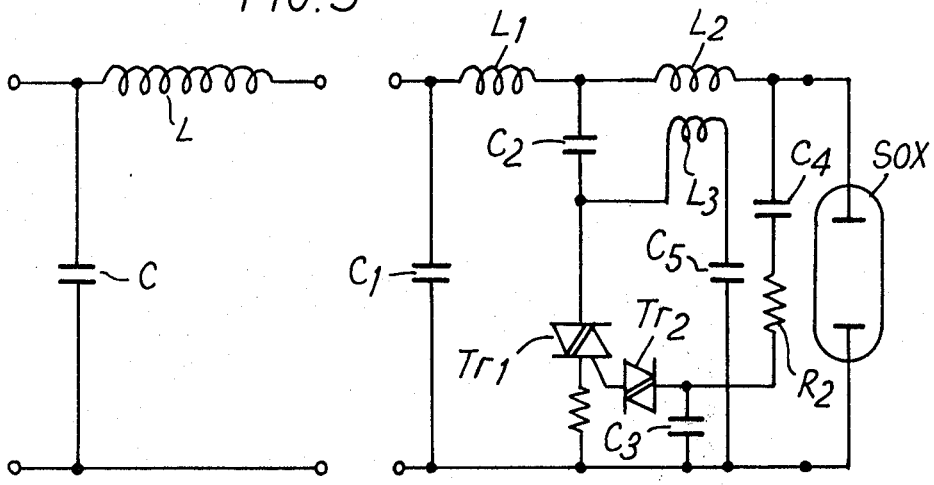
FIG. 3 is a circuit diagram of another existing lamp operating circuit and a third converter circuit according to the invention.

FIG. 3 shows the existing lamp operating circuit for a 250 watt MBF lamp and the converter circuit to be added thereto to produce a circuit for operating a 90 watt low pressure sodium lamp (SOX lamp). The existing MBF lamp operating circuit again consists of a series ballast inductor L and a power factor connecting capacitor C across the circuit input terminals. The converter circuit includes three inductor $L_1$, $L_2$ and $L_3$ all of which are smaller than the ballast inductor L which has a V/I ratio of substantially 70. The inductors $L_1$ and $L_2$ are in series with one another between one input terminal and one output terminal of the converter circuit and may be provided in the form of a single tapped winding. The inductor $L_3$ is a small coil wound over the inductor $L_2$.

When a.c. mains supply is initially applied to the input terminals of the existing lamp circuit of L and C connected to the converter circuit shown in FIG. 3, a capacitor $C_4$ and a capacitor $C_3$ in series with the inductors L and $L_1$, the coil $L_2$ and a resistor $R_2$ are charged. When the voltage across the capacitor $C_3$ reaches a certain level, a diac $Tr_2$ connecting the capacitor $C_3$ to the trigger of a triac $Tr_1$ breaks down and the capacitor $C_3$ discharges into the triac $Tr_1$ which therefore fires. When the triac $Tr_1$ fires, a capacitor $C_2$ forms a resonant circuit with the inductor $L_1$ and the coil $L_2$, and a capacitor $C_5$ forms a resonant circuit with the coil $L_3$ which is inductively coupled to the coil $L_2$. The resonant voltages established when the triac $Tr_1$ conducts serve to ignite the lamp. The triac $Tr_1$ is triggered in each half cycle of main frequency until the voltage across the lamp is too low for the diac $Tr_2$ to break down. It is arranged that the voltage across the lamp when it is running normally is too low to cause the diac $Tr_1$ to break down.

Thus the components $C_2$, $Tr_1$, $Tr_2$, $R_1$, $C_3$, $R_2$, $C_4$, $L_3$ and $L_5$ form an igniter circuit. The series inductance of the combination of the inductors $L_1$ and $L_2$ is chosen to add to the inductance of the ballast inductor L sufficiently to provide the effective series inductance required for operation of the SOX lamp.

A capacitor $C_1$ across the input terminals of the converter circuit protects the ballast inductor L from high voltage pulses originating in the converter circuit or the SOX lamp.

Figure 4:
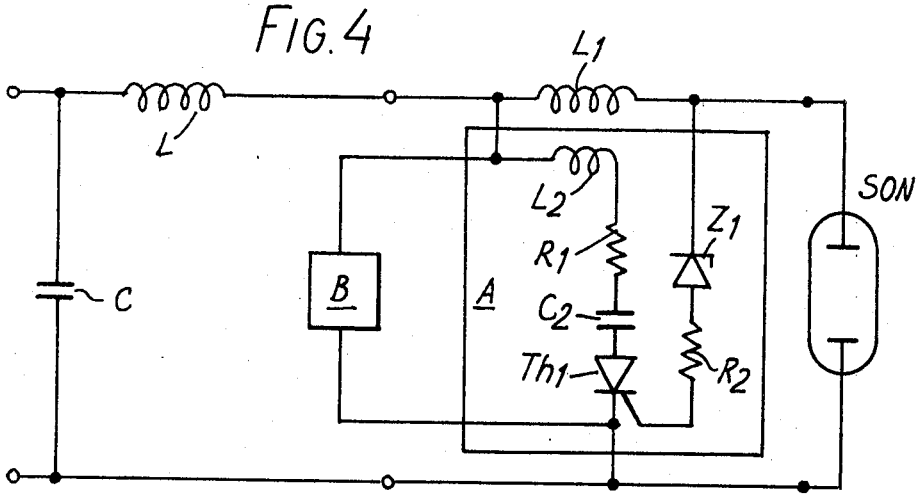
FIG. 4 is a further diagram of the circuits of FIG. 1.

The mercury lamp circuitry and the converter circuit of FIG. 1 are shown again in FIG. 4 in which the converter circuit is represented as composed of three elements: the inductor $L_1$ which is connected in series with the ballast inductor L to increase the series inductance to a value suitable for a SON lamp; the igniter circuit indicated within a region A and providing high voltage for igniting the SON lamp; and the protective circuitry, represented by a block B, which may be a snubber circuit as in FIG. 1, consisting of the capacitor $C_1$ and the resistor $R_3$, or another circuit capable of preventing transients and ignition voltage from reaching the ballast inductor L.

Figure 5:
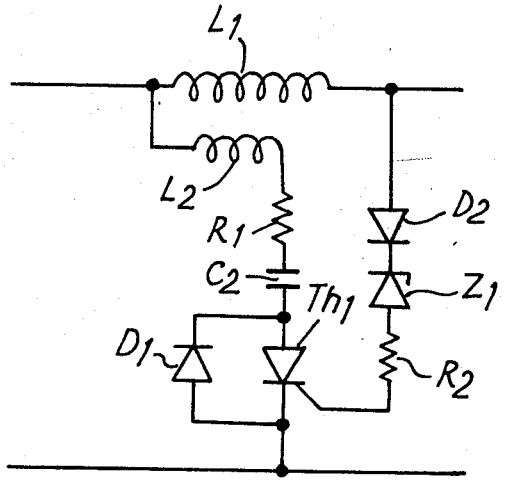

FIG. 5 shows elements A and $L_1$ again in which two diodes $D_1$ and $D_2$ are included in the igniter circuit A. The diode $D_1$ is connected in parallel with the thyristor $Th_1$ but with reverse polarity. As a result, the capacitor $C_2$ is charged to higher voltages than is the case in the circuit of FIGS. 1 and 4. The diode $D_2$ protects the trigger of the thyristor $Th_1$ from negative voltage.

Figure 7:
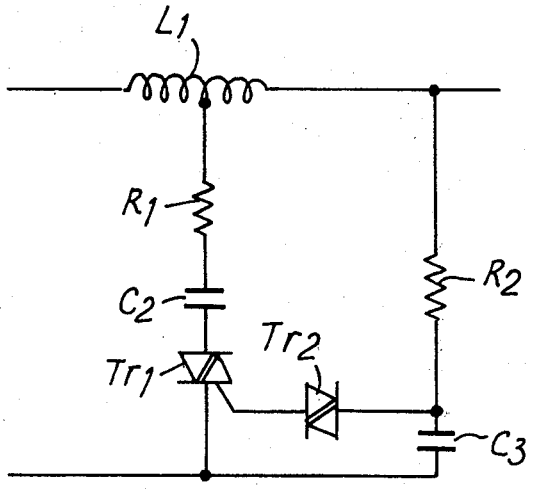
FIGS. 5, 6 and 7 are circuit diagrams of alternative circuitry for part of the converter circuit of FIGS. 1 and 4.
Figure 6:
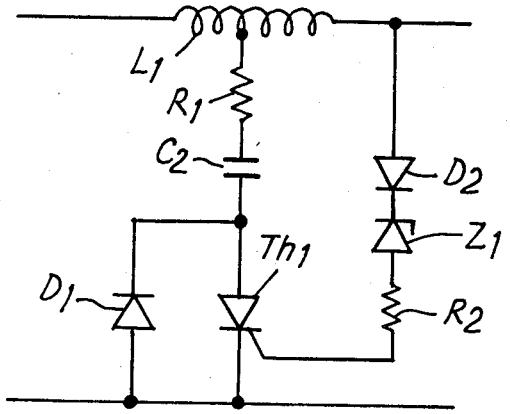

FIG. 6 shows a further modification in which the elements $L_1$ and A are merged by providing the inductor $L_1$ in the form of a tapped inductor, the resistor $R_1$ being connected to the tap and there being no winding $L_2$, the tapped inductor $L_1$ acting as an autotransformer. The igniter circuit shown in FIG. 7 combines features of FIGS. 3 and 6 in using a tapped inductor $L_1$ and a triac $Tr_1$ triggered through a diac $Tr_2$. The ignition voltage in the circuit of FIG. 7 is developed by resonance of $C_2$ with the tapped inductor $L_1$ whenever the triac $Tr_1$ fires. The voltage across the capacitor $C_3$ breaks the diac $Tr_2$ down in each mains frequency half cycle until the lamp voltage is too low for the capacitor $C_3$ to be sufficiently charged through the resistor $R_2$.

Figure 8:
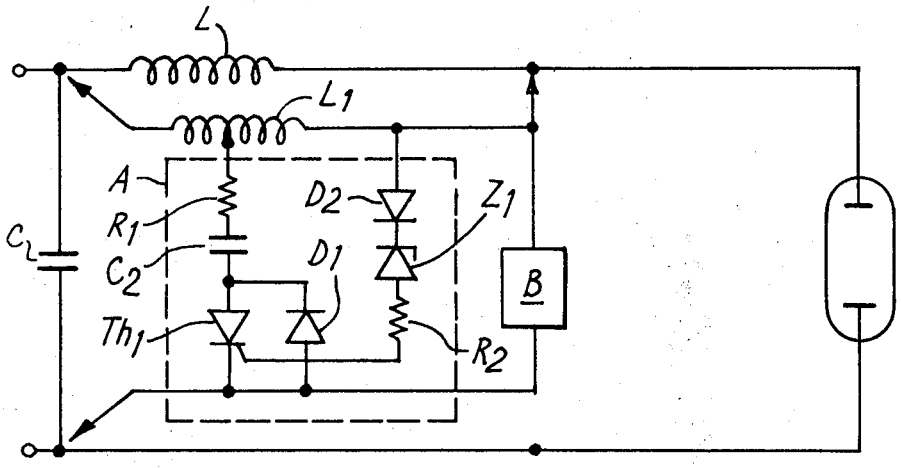
FIG. 8 is a circuit diagram of an existing lamp operating circuit with a fourth converter circuit according to the invention.
Figure 9:
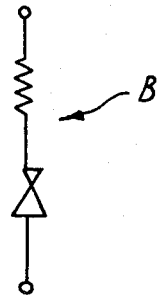
FIG. 9 is a detail diagram of part of the circuit of FIG. 8.

FIG. 8 shows a converter circuit similar to that formed by using the igniter A and tapped inductor $L_1$ of FIG. 6 but in which the inductor $L_1$ is arranged to be connected in parallel with the existing ballast inductor L. A consequence of this arrangement is that the protective circuitry B is connected across the lamp and therefore is not designed to suppress the ignition voltages but simply to limit peak voltages. An example of such protective circuitry is shown in FIG. 9 and consists of an ordinary resistor in series with a non-linear resistor. The purpose of so connecting the converter circuit that the inductor $L_1$ is in parallel with the existing ballast inductor L is to allow a more efficient lamp which has a higher arc current but a low voltage to replace an existing mercury vapour lamp. In operation initially, the thyristor $Th_1$ fires in each positive half cycle of mains supply frequency.

When the lamp strikes and the arc is maintained, the lamp voltage is insufficient for the voltage across the zener diode $Z_1$ to cause the zener diode $Z_1$ to conduct, and therefore the thyristor $Th_1$ does not fire. The zener diode $Z_1$ can be replaced by a Shockley diode.

As alternatives to the series combination shown in FIG. 9, the protective circuitry B may be a voltage dependent resistor, a semiconductor break-over diode or a similar device, or a snubber network formed of a capacitor and a resistor for attenuating fast rising transient voltages, or combinations of such arrangements.

Figure 10:
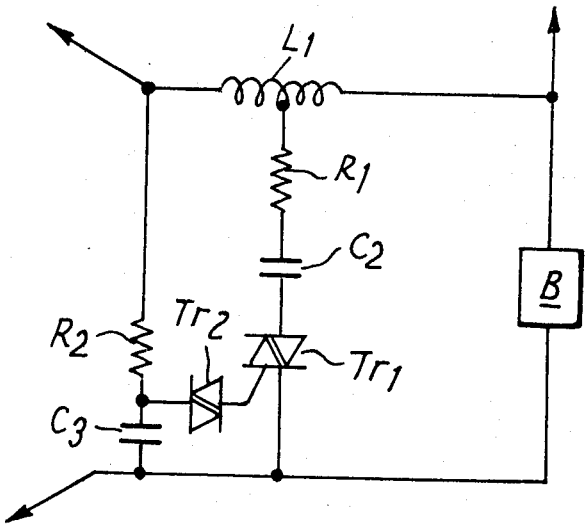
FIG. 10 is a diagram of an alternative to part of the converter circuit of FIG. 8.

FIG. 10 shows a converter circuit which is an alternative to that of FIG. 8 and is similar to the circuit of FIG. 7. The arrangement in FIG. 10, in which the capacitor $C_3$ and the resistor $R_2$ are connected across the input terminals of the converter circuit is suitable for a low pressure sodium lamp (SOX). The triac $Tr_1$ is in this case triggered from the resultant of the lamp voltage with the voltage across the tapped inductor $L_1$. However, for a high pressure sodium lamp (SON), the circuit of FIG. 10 should be adapted by connection of the series combination of the resistor $R_2$ and the capacitor $C_3$ across the lamp terminals as in FIG. 7.

Figure 11:
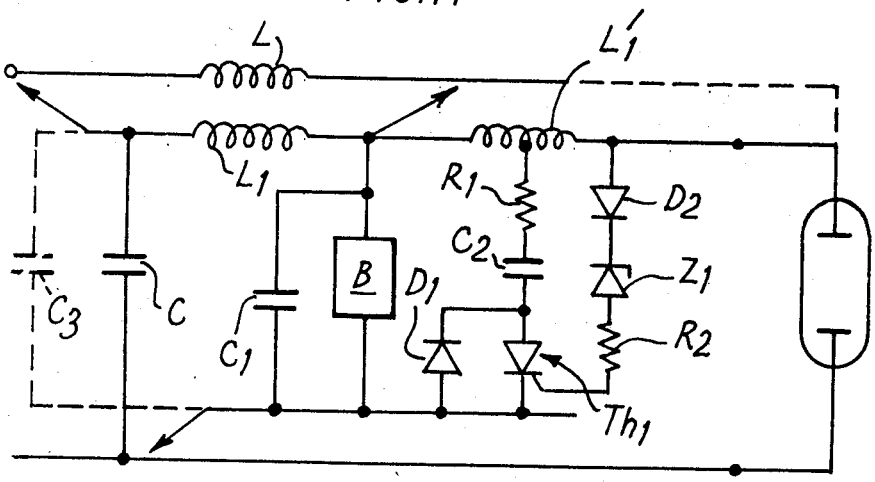
FIG. 11 is a circuit diagram of an existing lamp operating circuit with a fifth converter circuit according to the invention.

FIG. 11 shows a modification of the circuit of FIG. 8 in which substantially complete protection of the existing ballast inductor L from the transient voltages arising at the igniter circuit and the lamp is provided. The igniter circuit in FIG. 11 has tapped inductor $L_1'$ through which the whole of the lamp current flows. The converter circuit also includes an inductor $L_1$ connected in series with the inductor $L_1'$ and in parallel with the ballast inductor L. The lamp is connected across the igniter circuit as shown. The inductor $L_1'$ acts as the output transformer of the igniter circuit, and the inductor $L_1$ and the ballast inductor L in parallel present a reduced inductive impedance which, added to the inductance of the inductor $L_1'$ presents the replacement lamp with the required series inductance.

The inductors $L_1$ and $L_1'$ of the converter circuit may be formed as two parts of a tapped winding.

A decoupling capacitor $C_1$ is connected between the point at which all three inductors L, $L_1$ and $L_1'$ are connected together, and the common rail 20. A further degree of protection for the ballast inductor L may be provided by connection of an additional protection circuit B in parallel with the decoupling capacitor $C_1$. Thus the ballast inductor L is isolated from the igniter circuit and the lamp as regards high frequency voltage pulses and transients.

A capacitor $C_3$ may also be connected in parallel with the existing power factor correcting capacitor C to adjust the value of the power factor if necessary or desirable.

Figure 12:
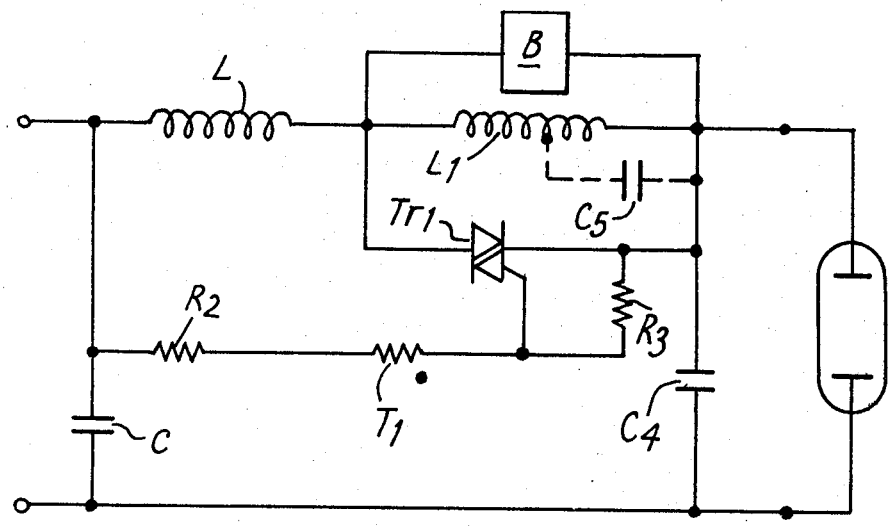
FIG. 12 is a circuit diagram of an existing lamp operating circuit with a sixth converter circuit according to the invention.
Figure 13:
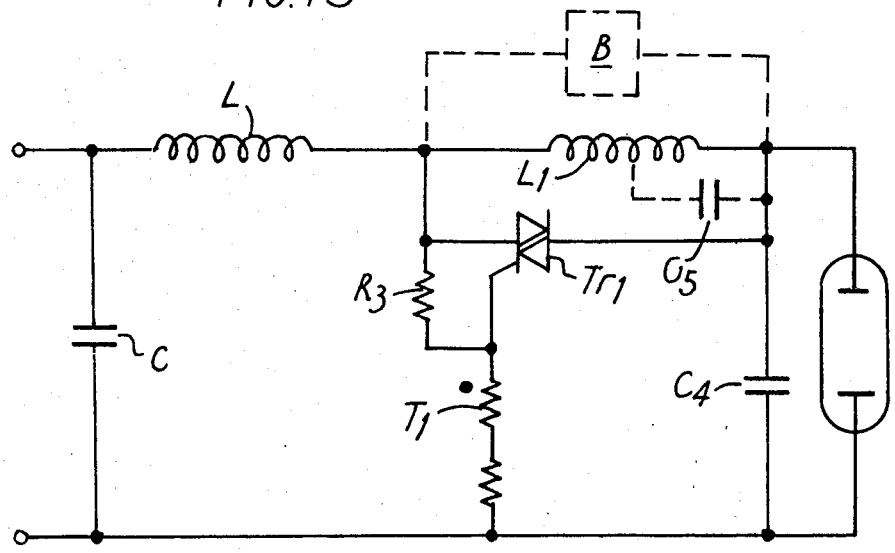
FIG. 13 is a circuit diagram of an existing lamp operating circuit with a seventh converter circuit according to the invention.

In some circumstances it may be necessary to adapt an existing lamp operating circuit to a replacement lamp by adding or subtracting series impedance during the running up of the lamp only, the modifying impedance provided by the converter circuit being switched out once the lamp reaches a suitable arc maintaining voltage. FIGS. 12 and 13 show converted lamp operating circuits in which the converter circuit has a single inductor $L_1$ connected in series with the existing ballast inductor L and the replacement lamp, and means for by-passing the converter inductor $L_1$ once a predetermined voltage is established either across the input terminals of the existing lamp operating circuit in the case of FIG. 12 or across the replacement lamp in the case of FIG. 13.

In FIG. 12, when power is first supplied to the existing lamp operating circuit input terminals, the replacement lamp is non-conducting and a small current flows in a capacitor $C_4$ which forms a series combination with a resistor $R_3$, a thermistor $T_1$ and a resistor $R_2$ across the operating circuit input terminals. The voltage thus developed across the resistor $R_3$ is sufficient to trigger a triac $Tr_1$ connected in series between the existing ballast inductor L and the capacitor $C_4$, and having its trigger connected to the point of connection between the thermistor $T_1$ and the resistor $R_3$. Triggering of the triac $Tr_1$ occurs at a high voltage and results in the generation of a voltage pulse across the converter inductor $L_1$. The magnitude of this voltage pulse can be increased by the provision of a capacitor $C_5$ connected as shown across part of the inductor $L_1$. Protective circuitry B is connected across the converter inductor $L_1$ to prevent high frequency voltages of greater than a safe level reaching the ballast inductor L. If necessary, to ensure ignition of the replacement lamp, further components may be connected to the converter inductor $L_1$ to form an igniter circuit such as the igniter circuit A of FIG. 6, the capacitor $C_4$ then being omitted. During running up of the replacement lamp, the triac $Tr_1$ passes a pulse of current just after the peak of each half-cycle of mains frequency voltage. The switching of the triac $Tr_1$ generates resonance in the resonant circuit formed by the converter inductor $L_1$ and the capacitor $C_4$, and also the capacitor $C_5$ if present.

When the replacement lamp ignites, a large steady a.c. voltage appears across the ballast inductor L and sufficient current flows through the thermistor $T_1$ as a result for the resistance of the thermistor $T_1$ to decrease to the point at which the triac $Tr_1$ is switched on hard, thereby shunting out the converter inductor $L_1$. The value of the resistor $R_3$ is chosen to assist in setting the condition at which the triac $Tr_1$ switches on hard.

Thus the converter inductor $L_1$ only passes a substantial proportion of the lamp current during running up of the lamp and can therefore by a small, high inductance winding, overheating of such a winding being avoided by its by-passing by the triac $Tr_1$ during steady operation of the lamp.

In FIG. 13, the circuitry operates similarly to that of FIG. 12 but with the difference that the series combination of the resistors $R_2$ and $R_3$ and the thermistor $T_1$ is connected in series with triac $Tr_1$ across the output terminals and hence across the lamp. Thus when the voltage across the lamp reaches a predetermined level, the triac $Tr_1$ switches on hard and shunts out the converter inductor $L_1$.

Figure 14:
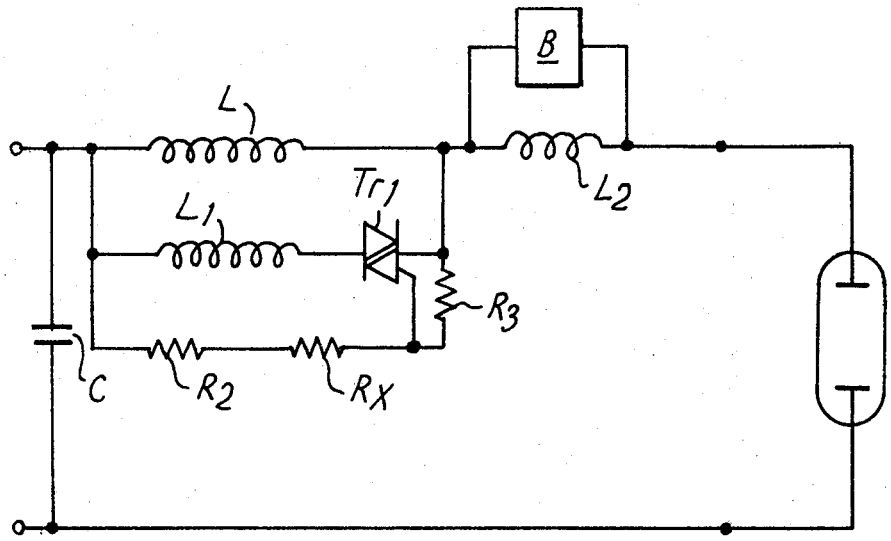
FIG. 14 is a partial circuit diagram of an existing lamp operating circuit with an eighth converter circuit according to the invention.

FIG. 14 shows a converted lamp operating circuit in which the converter circuit is arranged to switch an inductor $L_1$ into parallel connection with the existing ballast inductor L when the lamp current reaches a predetermined level, the inductor $L_1$ being connected in series with a triac $Tr_1$ arranged to be triggered by a voltage dividing series combination of resistors $R_2$, $R_X$ and $R_3$ connected as shown across the ballast inductor L so that the voltage applied to trigger the triac $Tr_1$ depends on the current through the ballast inductor L. The resistor $R_X$ may be an ordinary resistor or a thermistor, depending on the requirements of the particular circuit. An igniter circuit is provided of which only the inductor $L_2$, connected in series with the ballast inductor L, is shown.

Protective circuitry B is connected across the igniter inductor $L_2$.

When the lamp is running steadily, the effective series inductance is provided by the igniter inductor $L_2$ and the parallel combination of the ballast inductor L and the switched in inductor $L_1$.

FIG. 15 shows a converter circuit according to the present invention for converting an existing lamp operating circuit, not shown but consisting of a series ballast inductor and a power factor connecting capacitor connected across the operating circuit input terminals as in FIG. 1, into a circuit for operating a SON lamp fitted with an internal starter such as a bi-metal snap switch or a glow starter similar to the internal starter used in hot cathode fluorescent lamps. An example of such a SON lamp is a 50 watt or a 70 watt Phillips SON lamp with internal starter. SON lamps with bi-metal switches, ignite almost instantaneously when the alternating supply is first switched on with the lamp cold. However, these lamps fail to re-strike when the lamp is hot, since the heat of the lamp causes the bi-metal switch to remain open for fifteen or more minutes after the lamp has extinguished. It is known to provide an external electronic igniter circuit for re-striking such lamps, but the known igniter circuits have a tendency, especially where the internal starter is a glow starter, to interfere with the initial striking of the lamp, since the voltage generated by the external igniter circuit jumps across the internal igniter so that both the externally generated igniter voltage and the internally generated igniter voltage are short circuited and the lamp fails to strike. Use of a low voltage external igniter, i.e. 1 kilovolt instead of 2.3 kilovolts to 5 kilovolts, is unsatisfactory also in that the time taken to re-strike the lamp when hot is longer than for the higher igniter voltage and if the self-starting lamp is subsequently replaced with a lamp which does not have an internal starter, the replacement lamp is likely to fail to strike initially since 1 kilovolt is not sufficient to ignite most SON lamps when cold.

In the converter circuit of FIG. 15, the circuitry essentially corresponds to that of the converter circuit of FIG. 4 except for the additional provision of a unit E connected in series between the common rail 20 and the remainder of the converter circuit. A blocking capacitor $C_1$ is connected as in the circuit of FIG. 11 to prevent high frequency voltage from reaching the ballast inductor of the existing lamp operating circuit, this ballast inductor (not shown) being connected in series with the converter inductor $L_1$.

FIGS. 16 and 17 show alternative arrangements constituting the unit E of FIG. 15. In FIG. 16 the unit E is simply a thermistor $T_1$. When a converted circuit in which the unit E is the thermistor $T_1$ is initially supplied with a.c. mains voltage, the thermistor $T_1$ is cold and is therefore in its high impedance state. The igniter circuit portion of the converter circuit operates as in FIG. 4 but does not generate significant voltage across the lamp, and the converter circuit does not place any significant impedance across the lamp. Consequently the internal starter of the lamp is able to operate properly and ignite the lamp with the combined series inductance of the existing ballast inductance (not shown) and the converter inductor $L_1$ in circuit. As the igniter portion of the converter circuit continues to operate before the lamp strikes, current flows through the unit E, i.e. the thermistor $T_1$, so that the impedance of the unit E falls steadily. As a result, the voltage pulses generated across the lamp by the converter circuit increase in magnitude smoothly. It is found that the smoothly increasing externally generated voltage pulses assist the internally generated pulses and do not short circuit the contacts of the internal starter (not shown). The lamp is found to strike sooner than with the internal starter alone. When the lamp strikes, the thyristor $Th_1$ ceases to be triggered and therefore the current through the unit E is substantially reduced and the impedance of the unit E become high again. If the lamp extinguishes while hot, voltage pulses are soon provided by the converter circuit which are high enough to effect rapid re-striking. Furthermore, if the lamp is replaced with a SON lamp not having an internal starter, the voltage pulses generated by the converter circuit when this lamp is cold rapidly reach a magnitude sufficient to ignite the cold lamp. Thus the converter circuit monitors the lamp voltage and generates output voltage pulses whenever the lamp voltage is below the level predetermined by the triggering branch consisting of the resistor $R_2$, diode $D_2$ and zener diode $Z_1$ (which may alternatively be a Shockley diode). The output pulses increase smoothly in magnitude over a time determined by the unit E and reach a level at which the lamp strikes.

In FIG. 17, the unit E consists of a thyristor $Th_2$ arranged to be controlled by a voltage divider formed by a series combination of an ordinary resistor $R_3$ and a thermistor $T_1$ or some other non-linear resistor whose impedance varies with current as in a thermistor. The thermistor $T_1$ is connected between the trigger and the anode of the thyristor $Th_1$ and the values of resistance presented by the resistor $R_3$ and the thyristor $Th_2$ are such that as the thermistor $T_1$ warms up and its resistance decreases, the voltage at the trigger of the thyristor $Th_2$ reaches the level at which the thyristor $Th_2$ fires. Hence, in operation with the lamp cold, the current allowed by the unit E of FIG. 17 starts from the small amplitude allowed by the series combination of the resistor $R_3$ and the thermistor $T_1$ when cold, the thyristor $Th_2$ being off, and increases smoothly as the thermistor $T_1$ warms up, until the thyristor $Th_2$ fires whereupon the current increases substantially. The unit E of FIG. 17 conducts until the lamp voltage drops to the level at which the igniter circuit of FIG. 15 ceases operation, and then the thyristor $Th_2$ turns off.

A practical circuit according to FIGS. 15 and 16 for operating a 50 or 70 watt Phillips SON lamp with an internal starter has the following component values:

Inductor $L_1$: 300 turns tapped at 100 turns and wound on a ¾ inch (1.9 cm) stack of No. 35 laminations from Linton and Hirst Ltd, England.

Thyristor $Th_1$: TL 107

Capacitor $C_1$: 0.02 microfarad

Capacitor $C_2$: 0.33 microfarad

Zener diode $Z_1$: PL 200Z Zener diode by SSC Ltd, England

Diode $D_1$: PY 127 diode by SSC Ltd

Thermistor $T_1$: VA 1056 S by Mullard Ltd, England

Resistor $R_1$: 3.3 kilohms.

I claim:

1. A converter circuit for connection between an existing electric discharge lamp operating circuit and a replacement electric discharge lamp of a different type from that intended to be operated by the existing electric discharge lamp operating circuit, the converter circuit comprising: converter inductance means connectable to adjust total series inductance to a value suitable for operation of said replacement lamp;

igniter circuitry coupled to said converter inductance means for producing ignition voltages;

converter output terminal means connected to said converter inductance means and to said igniter circuitry to apply, in use, said ignition voltages to said replacement lamp; and voltage protection means coupled to said igniter circuitry to protect, in use, said existing lamp operating circuit from said ignition voltages.

2. A converter circuit as claimed in claim 1, wherein said igniter circuitry comprises semiconductor switching means coupled to resonant circuit means whereby resonance voltages are established in said igniter circuitry by switching off said semiconductor switching means.

3. A converter circuit as claimed in claim 2, wherein said semiconductor switching means comprises a thyristor having a trigger terminal coupled through a voltage breakdown device to an output end of said converter inductance means.

4. A converter circuit as claimed in claim 2, wherein said semiconductor switching means comprises a triac having a trigger terminal coupled by a diac to a capacitor arranged to be chargeable to a breakdown voltage of the diac.

5. A converter circuit as claimed in claim 2, wherein said semiconductor switching means is arranged to by-pass said converter inductance means.

6. A converter circuit as claimed in claim 2, wherein said semiconductor switching means comprises a thyristor and said igniter circuitry is connected in series with means for decreasingly restricting current passed therethrough.

7. A converter circuit as claimed in claim 1, wherein said igniter circuitry includes part of said converter inductance means.

8. A converter circuit as claimed in claim 7, wherein said converter inductance means comprises a tapped inductor.

9. A converter circuit as claimed in claim 1, wherein said converter inductance means includes a winding adapted to be connected in parallel with an inductance portion of an existing lamp operating circuit, and a further winding connected in series with the first said winding and connected to form part of the igniter circuitry, said voltage protection means being connected to a current point between said windings.

10. A converter circuit as claimed in claim 1, wherein said igniter circuitry is connected in series with means for decreasingly restricting current passed therethrough.

11. A converter circuit as claimed in claim 10, wherein said current restricting means comprises a thermistor.

* * * * *

UNITED STATES PATENT AND TRADEMARK OFFICE

CERTIFICATE OF CORRECTION

PATENT NO. : 4,342,948

DATED : August 3, 1982

INVENTOR(S) : Philip R. Samuels

It is certified that error appears in the above–identified patent and that said Letters Patent are hereby corrected as shown below:

On the Title page, Item [73], please change the Assignee to --Davis Engineering Limited--.

Signed and Sealed this

*Twelfth* Day of *October 1982*

[SEAL]

*Attest:*

GERALD J. MOSSINGHOFF

*Attesting Officer*

*Commissioner of Patents and Trademarks*